US012467646B2

(12) United States Patent
Anderberg et al.

(10) Patent No.: US 12,467,646 B2
(45) Date of Patent: Nov. 11, 2025

(54) VENTILATION MEMBER WITH HOLDING CLIP AND SYSTEMS INCORPORATING THE SAME

(71) Applicant: Stockton Products, North Las Vegas, NV (US)

(72) Inventors: Thomas Arthur Anderberg, Oakland, CA (US); Angelberto Torres, La Puente, CA (US)

(73) Assignee: Stockton Products, North Las Vegas, NV (US)

( * ) Notice: Subject to any disclaimer, the term of this patent is extended or adjusted under 35 U.S.C. 154(b) by 445 days.

(21) Appl. No.: 18/046,897

(22) Filed: Oct. 14, 2022

(65) Prior Publication Data

US 2024/0125496 A1 Apr. 18, 2024

(51) Int. Cl.
*F24F 7/04* (2006.01)
*F24F 13/02* (2006.01)

(52) U.S. Cl.
CPC ..... *F24F 7/04* (2013.01); *F24F 13/0209* (2013.01); *F24F 13/0227* (2013.01); *F24F 13/0245* (2013.01)

(58) Field of Classification Search
CPC ..... F24F 7/04; F24F 13/0209; F24F 13/0227; F24F 13/0245
See application file for complete search history.

(56) References Cited

U.S. PATENT DOCUMENTS

| | | | | |
|---|---|---|---|---|
| 7,673,421 | B2 | 3/2010 | Pilz | |
| 7,874,123 | B2 | 1/2011 | Maziarz | |
| 8,584,416 | B2 | 11/2013 | Chenier et al. | |
| 9,279,247 | B2 | 3/2016 | Maziarz | |
| 10,024,063 | B2 | 7/2018 | Friel | |
| 10,196,812 | B1 * | 2/2019 | Duffy | E04F 13/007 |
| 10,221,586 | B2 | 3/2019 | Mayer, Jr. | |
| 10,494,818 | B2 | 12/2019 | Maziarz | |
| 10,533,324 | B2 * | 1/2020 | Baltz, Jr. | E04B 1/7076 |
| 10,570,640 | B2 | 2/2020 | Mayer, Jr. | |
| 10,655,336 | B2 | 5/2020 | Friel | |
| D887,586 | S | 6/2020 | Baltz, Jr. et al. | |
| D888,285 | S | 6/2020 | Baltz, Jr. et al. | |
| 10,669,721 | B2 | 6/2020 | Baltz, Jr. et al. | |
| D889,247 | S | 7/2020 | Baltz, Jr. et al. | |
| D893,051 | S | 8/2020 | Baltz, Jr. et al. | |
| 10,731,335 | B2 | 8/2020 | Baltz, Jr. et al. | |
| 10,731,354 | B2 | 8/2020 | Friel | |
| 10,753,083 | B2 | 8/2020 | Baltz, Jr. et al. | |
| D896,993 | S | 9/2020 | Baltz, Jr. et al. | |
| 10,774,545 | B2 | 9/2020 | Baltz, Jr. et al. | |
| D902,443 | S | 11/2020 | Baltz, Jr. | |
| D903,146 | S | 11/2020 | Baltz, Jr. et al. | |
| D905,295 | S | 12/2020 | Baltz, Jr. et al. | |

(Continued)

OTHER PUBLICATIONS

Koester, John H., "Getting to the Bottom of Moisture Management", 2015 Masonry Technology Inc., 7 pages.

*Primary Examiner* — Allen R. B. Schult
(74) *Attorney, Agent, or Firm* — Womble Bond Dickinson (US) LLP

(57) ABSTRACT

Ventilation members for venting and/or draining moisture in building structures include a base panel and at least a transversely extending panel. Vent or drain openings are provided through the transverse panel, and a holding clip extends from the transverse panel for holding a drainage mat in place.

20 Claims, 13 Drawing Sheets

(56) References Cited

U.S. PATENT DOCUMENTS

| | | | |
|---|---|---|---|
| 10,947,722 | B2 | 3/2021 | Baltz, Jr. et al. |
| D923,821 | S | 6/2021 | Baltz, Jr. et al. |
| 11,180,913 | B2 | 11/2021 | Baltz, Jr. et al. |
| 11,180,928 | B2 | 11/2021 | Mayer, Jr. |
| D940,349 | S | 1/2022 | Baltz, Jr. et al. |
| D940,350 | S | 1/2022 | Baltz, Jr. et al. |

* cited by examiner

VENTILATION MEMBER WITH HOLDING CLIP AND SYSTEMS INCORPORATING THE SAME

BACKGROUND

Stucco, plaster or other claddings are typically used for exterior surfaces of building structures defining substrates such as walls. Such claddings are applied over a wire mesh over felt paper which has been attached to underlying substrate, e.g. wall. This method of cladding installation often results in leak problems between the cladding and the substrate and often results in the collection of moisture between the cladding and substrate.

Weep screeds are often used with claddings over walls towards a top end of the wall, bottom end of the wall or mid-wall (as for example externally between floors) to act as a stop for the cladding applied to the wall. Weep screeds generally have a panel that abuts the wall and a leg that extends transversely outward to provide a surface for the cladding to contact. Weep screeds also allow moisture to be collected between the cladding and the substrate to drain. However, better drainage systems are desired that are easier to use and allow for venting of the moisture collected between the substrate and the cladding upwards and allow for drainage of moisture downwards.

SUMMARY

In an example embodiment, a ventilation member includes a base panel for mounting on a substrate, a first panel extending transversely from the base panel, a second panel extending transversely from the base panel and spaced apart from the first panel at least one opening formed through the second panel proximate the base panel. A holding clip extends transversely from the second panel in a direction away from the first panel, and a space is defined between the holding clip and the base panel. The space has a first width and second width narrower than the first width. In one example embodiment, the holding clip is moveable for allowing for insertion of a drainage mat into the space and is biased for providing pressure against the drainage mat once inserted. In another example embodiment, the holding clip is a rigid member and includes a surface portion at the second width for engaging a drainage mat once inserted into the space. In a further example embodiment, the holding clip includes a base portion extending from the first panel and a head having a curved outer extending distally from the base portion. In yet another example embodiment, the space has a width as measured between a surface of the base panel facing the holding clip and a surface of the holding clip base portion facing the base panel, and the width decreases and then increases in a direction from the proximal end of the head adjacent the base portion to the distal end of the head. In a further example embodiment, the width at the distal end of the head is greater than the width at the proximal end of the head. In yet a further example embodiment, the second panel includes a first portion forming a shelf adjacent the base panel and a second portion extending distally from the first portion in a direction away from the base panel, and the at least one opening is formed through the shelf. In one example embodiment, the first panel forms a lower leg extending from, or proximate a lower end of the base panel, and inclining downward from the base panel and the second panel forms an upper leg above the lower leg, and the second portion of the second member inclines downward from the shelf. In another example embodiment, the first panel forms an upper leg extending from, or proximate, an upper end of the base panel and the second panel forms a lower leg, and the second portion of the second panel inclines downward from the shelf. In yet another example embodiment, the ventilation member also includes at least one of a first leg portion extending downward from the first panel and a second leg portion extending downward from the second panel. In a further example embodiment, the ventilation member is formed by extrusion. In yet a further example embodiment, the ventilation member base panel, first panel, second panel, and holding clip are integrally formed by bending a single sheet of material to sequentially define each of the base panel, first panel, second panel and holding clip.

In another example embodiment, a ventilation member includes a base panel for mounting on a substrate, a first panel extending transversely from the base panel, a second panel extending transversely from the base panel and spaced apart from the first panel, a third panel extending transversely from the base panel and spaced apart and between the first and second panels, at least one first opening formed through the first panel, at least one second opening formed through the second panel, and a holding clip extending transversely from one of the first and second panels in a direction away from the other two panels. A space is defined between the holding clip and the base panel, such that the space has a first width and second width narrower than the first width. In one example embodiment, the holding clip is moveable for allowing for insertion of a drainage mat into the space and is biased for providing pressure against the drainage mat once inserted. In another example embodiment, the holding clip is a rigid member and includes a surface portion at the second width for engaging a drainage mat once inserted into the space. In yet another example embodiment the holding clip includes a base portion extending from the one of the first panel and second panel and a head having a curved outer surface extending distally from the base portion. In a further example embodiment, the space has a width as measured between a surface of the base panel facing the holding clip and a surface of the holding clip facing the base panel, and the width decreases and then increases in a direction from the proximal end of the head adjacent the base portion to the distal end of the head. In yet a further example embodiment, the at least one of the first and second panels includes a first portion forming a shelf adjacent the base panel and a second portion extending distally from the first portion in a direction away from the base panel, and the at least one first opening or the at least one second opening is formed through the shelf. In one example embodiment, the holding clip is a first holding clip extending from the first panel in a direction away from the second and third panels, and the ventilation member includes a second holding clip extending from the second panel in a direction away from the first and third panels, and the space is a first space and a second space is defined between the second holding clip and the base panel. The second space has a first width and second width narrower than the first width of the second space. In one example embodiment, the second holding clip is moveable for allowing for insertion of a drainage mat into the space and is biased for providing pressure against the drainage mat once inserted. In another example embodiment, the second holding clip is a rigid member and includes a surface portion at the second width of the second space for engaging a drainage mat once inserted into the space. In another example embodiment, each of the first and second holding clips includes a base portion extending from its corresponding first or second panel and a head having a curved outer surface extending distally from its base portion. In yet another example embodiment, the first space has a first space width as measured between a surface of the base panel facing the first holding clip and a surface of the first holding clip facing the base panel, and the second space has a second space width defined between a surface of the base panel facing the second holding clip and a surface of the second holding clip facing the base panel, and each of the first space and second space widths decreases and then increases in a direction from the proximal end of its corresponding head adjacent its corresponding base portion to the distal end of its corresponding head. In a further example embodiment, the first space width at the distal end of the head of the first holding clip is greater than the first space width at the proximal end of the head of the first holding clip, and wherein the second space width at the distal end of the head of the second holding clip is greater than the second space width at the proximal end of the head of the second holding clip. In yet a further example embodiment, the first panel includes a first portion forming a first shelf adjacent the base panel and a second portion extending distally from the first portion in a direction away from the base panel, and the at least one opening formed through the first panel is formed through the first shelf, and the second panel includes a third portion forming a second shelf adjacent the base panel and a fourth portion extending distally from the third portion in a direction away from the base panel, and the at least one opening formed through the second panel is formed through the second shelf. In yet a further example embodiment, the second portion is inclined downward relative to the first portion and the fourth portion is inclined downward relative to the third portion. In one example embodiment, the third panel forms a leg extending from the base panel and inclining downward. In another example embodiment, the ventilation member includes a first member and a second member, and the first member includes the first panel, and the second member includes the second and third panels. In another example embodiment, the first and second members are each formed by extrusion. In yet another example embodiment, the first member is formed from a first single piece of material that is bent to define the first panel and the second member is formed a second single piece of material that is bent to define the second and third panels. In a further example embodiment, the ventilation member is formed by extrusion. In yet a further example embodiment, the ventilation member base panel, first panel, second panel, third panel, first holding clip and second holding clip are integrally formed by bending a single sheet of material to sequentially define each of the base panel, first panel, second panel, third panel, first holding clip and second holding clip. In one example embodiment, the third panel includes a first surface opposite a second surface, and the distance between the first surface and the second surface proximate the base panel is expandable whereby expanding the distance increases a distance between the first and second panels.

DESCRIPTION

Figure 1A:
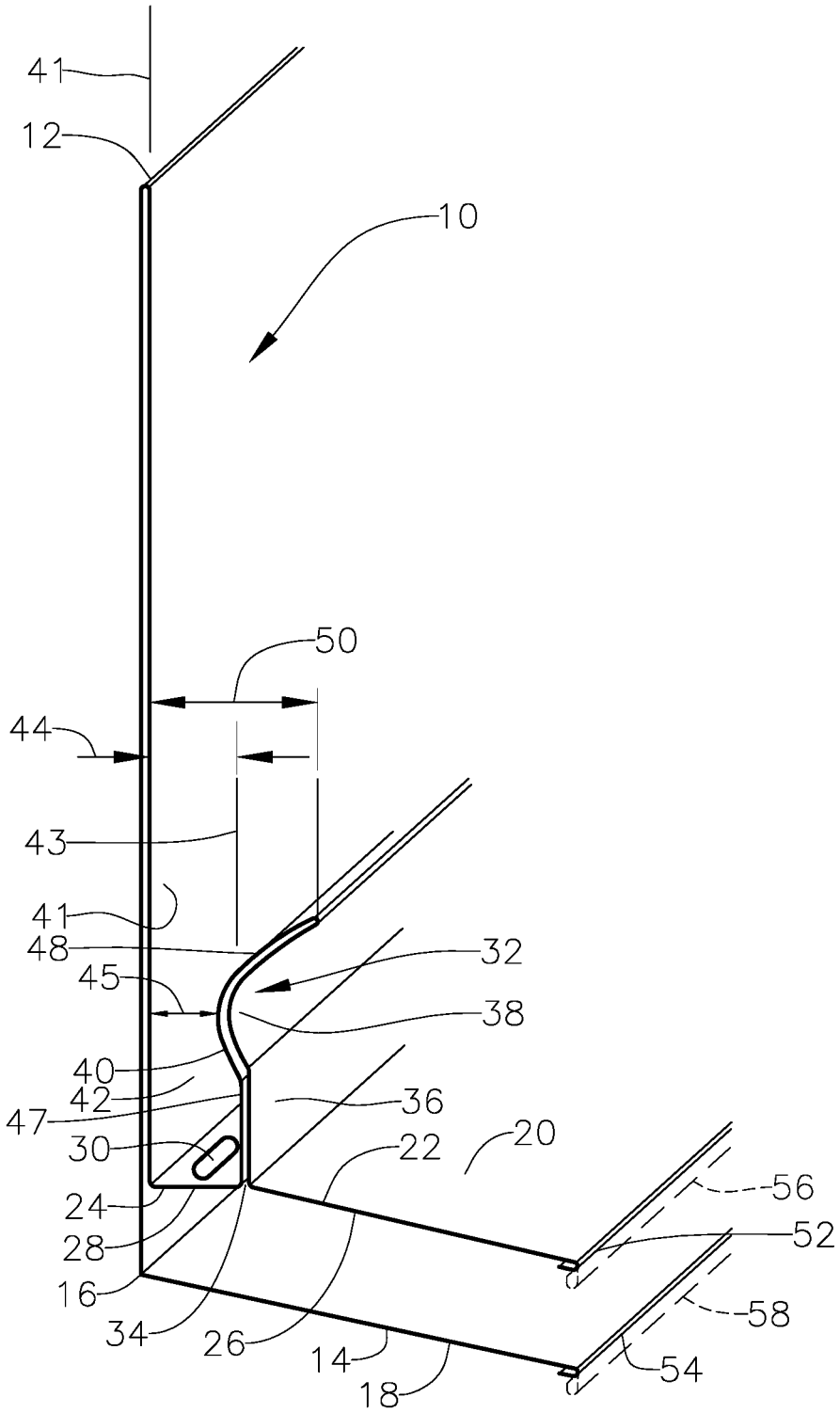
FIGS. 1A and 1B are partial perspective views of an example embodiment lower ventilation member.
Figure 2:
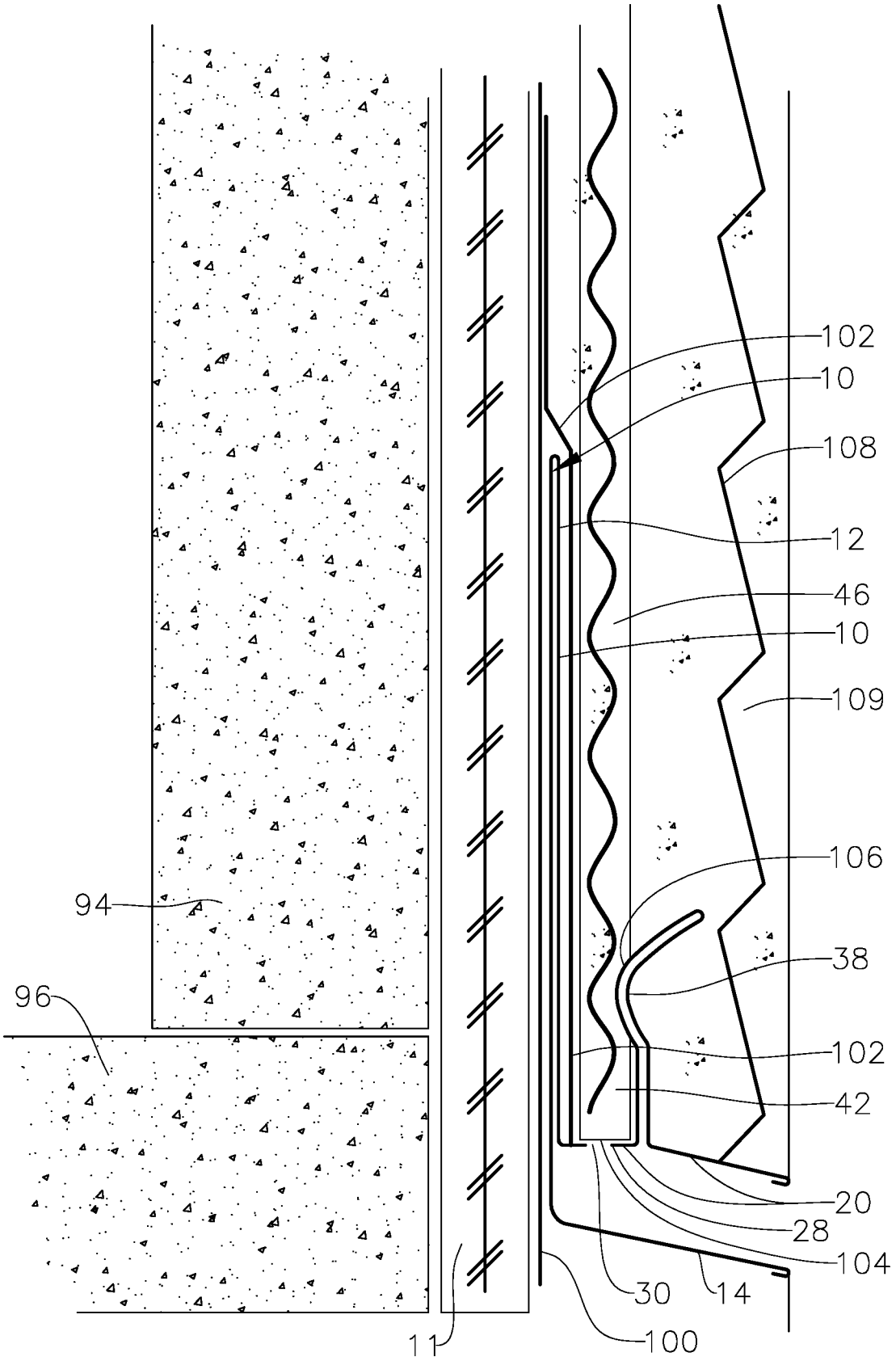
FIG. 2 is an end view of the example embodiment lower ventilation member shown in FIG. 1A mounted over a wall.

An example embodiment ventilation member 10 (referred to herein as a "lower ventilation member") for use at, or proximate, a lower end of a wall 94 proximate a base or floor 96, as shown in FIGS. 1A, and 2, includes a base panel or nailing flange 12 for being mounted on a substrate 11 (e.g., a wall of a structure such as a building, or a sheathing or other material attached to such wall). In the example embodiment shown in FIG. 2, the base panel is mounted on sheathing. A first or lower panel 14 extends transversely from, or proximate, a lower end 16 of the base panel forming a first or lower leg 18. A second or upper panel 20 extends transversely from the base panel 12 proximate the lower end 16 of the base panel and spaced apart from, and above, the lower panel forming a second or upper leg 22. In an example embodiment the lower panel is inclined downward in a direction away from the base panel. In another example embodiment, the upper panel has a first portion 24 adjacent to the base panel and a second portion 26 extending distally from the first portion in a direction away from the base panel and inclined downward. The first portion defines a shelf 28, and in the shown example embodiment, a generally horizontal shelf. One or more drain openings 30 are formed through the shelf. A holding clip 32 extends upward from the upper panel 20 at a location proximate, or at, the intersection 34 between, the first and second portions of the upper panel. In one example embodiment, the holding clip is a spring clip, while in another example embodiment it is a rigid clip. The holding clip has a base portion 36 and a head 38. The base portion extends from the upper panel and the head extends distally from the base portion. In the shown example embodiment, the head is a curved (i.e., radiused) member, or is a member having a curved outer surface, defining an arc 40 extending in a space 42 defined between a plane 41 of the base panel along a base panel surface facing the holding clip and a generally parallel plane 43 along a surface 47 of the base portion facing the base panel. The space 42 has a width 44 as measured between the generally parallel planes. The space is aligned with the one or more drain openings 30. The space 42 is defined between the holding clip 32 and the base panel 12 to receive a lower end of a drainage mat 46. "Drainage mat" as used herein refers to any type of structure can cover a surface area and is capable of absorbing and draining or venting moisture, through its upper and lower ends. A rainscreen is an example of a drainage mat.

In a direction from base portion to the upper end of the head 38, the head outer surface 48 curves extending in a direction toward the base panel, such that a width 45 between the outer surface of the head and the plane 41 of the base panel, parallel to the width 44 between the generally parallel planes, is narrower than the width 44. Continuing in the same direction the outer surface of the head curves in a direction away from the base panel thereby increasing the width of the spacing between the base panel plane and the outer surface of the head. In an example embodiment, the distal end of the head extends in a direction away from the base panel such that a width 50 between outer surface of the head at its distal end and the base panel plane 41, parallel to the width 44, is greater than the width 44 of the space. The outer surface of the distal end portion of the head serves as a guide to receive and guide the lower end of the drainage mat into the space 42 and the head serves to engage the drainage mat for holding it in place.

In an example embodiment, the distal end 52, 54 of each of the upper and lower panels, respectively, may be rounded or blunt. In another example embodiment, a generally vertically and downwardly extending lip 56, 58, may extend from either or both of the distal ends of the upper and lower panels, respectively.

Figure 1B:
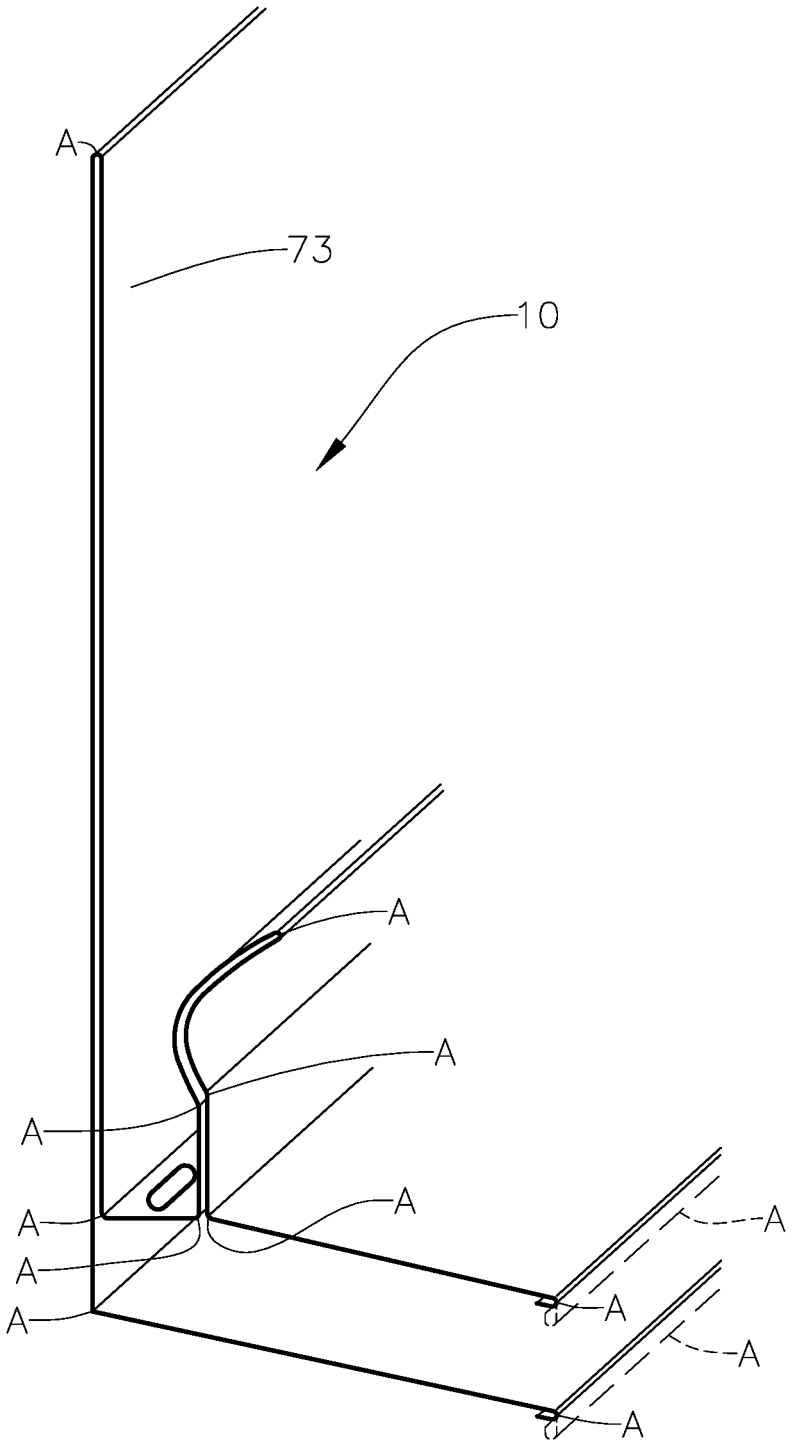
Figure 1C:
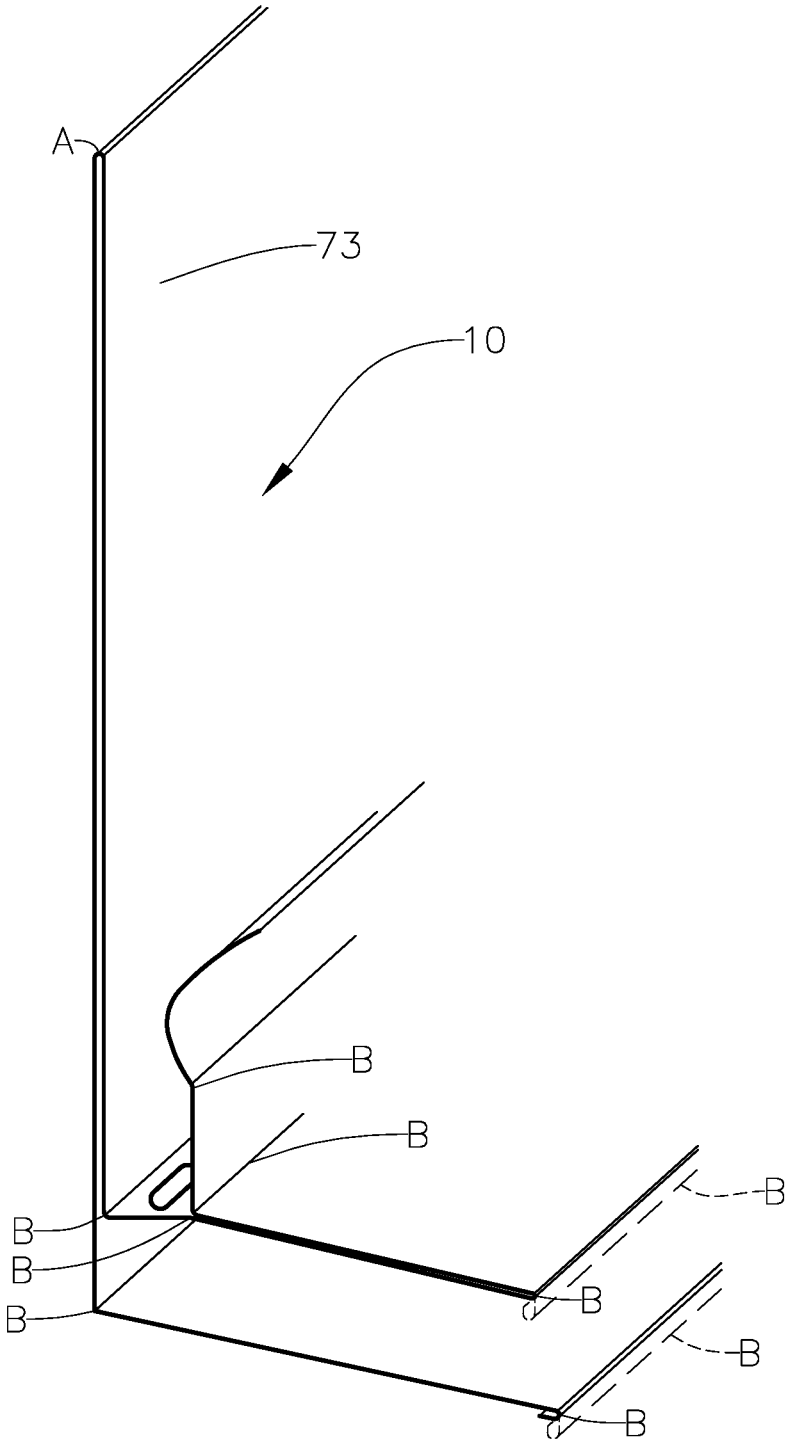
FIG. 1C is a partial perspective view of another example embodiment lower ventilation member.

In an example embodiment, the lower ventilation member may be extruded from an extrudable material such as plastic or metal to be a unitary structure. In another example embodiment, one or more of the base panel, upper panel, lower panel, holding clip and any lips may be separate members that are connected or attached to each other. In further example embodiment the entire lower ventilation member is formed from a single or a unitary piece of material which is folded onto itself. In example embodiments, a single panel 73 is used to form the lower ventilation member 10 by bending the panel 73 at points A, or points B as shown in FIGS. 1B and 1C, respectively.

In an example embodiment, the lower ventilation member 10 is mounted at, or proximate, a lower end of a wall 94 and often extends beyond the lower end of the wall and over base structure, such a structure forming a base or a floor 96, as for example shown in FIG. 2. In an example embodiment a substrate 11 such as sheathing is mounted over the wall and may also extend over the base or floor. In another example embodiment, the substrate may be the wall itself. A water resistive barrier layer 100 is mounted over the substrate over the wall and floor. Water resistive barriers are well known in the art. They are often barrier films or layers which resist penetration by water, moisture, or vapor. The base panel 12 is mounted over the water resistive barrier and if a floor is present at a location such that the upper and lower panels 20, 14 extend from a location within a height of the floor. A flashing layer (i.e., a layer of flashing material) 102, is then placed over the base panel extending from a location at, or proximate, the upper panel 20 and extending above the base panel 12 so that it contacts the water resistive layer 100 above the base panel 12. Flashing layers are layers of a moisture impervious material and are well known in the art. A drainage mat 46 is then slid into position into the space 42 between the holding clip 32 and base panel 12 such that the lower end 104 of the drainage mat contacts, or is proximate, the upper panel 20 (or shelf 28) and in-line with the drain openings 30. The head 38 of the holding clip provides for an extended outer surface 106 that is contacted by the lower end 104 of the drainage mat as it is slid into position. As the drainage mat is further pushed downward, it slides along the outer surface 106 of the holding clip head causing the holding clip when it is a spring clip to move in a direction away from the base panel allowing the drainage mat to move into the space 42. The holding clip then due to its spring bias, returns to, or proximate, its original position, contacting or pinching upon the drainage mat for holding it into position. In an example embodiment, where the holding clip is a rigid clip, the drainage mat slides along the outer surface 106 of the holding clip and as it gets pushed further down and into the space 42, through the narrowed width 45 of the space 42, the head of the holding clip exerts a pressure or pinches against the drainage mat holding it in place. With either of these embodiments, the width 145 is narrower than the width of the drainage mat. A lath 108 may then be placed over the drainage mat and cladding 109, such as stucco, siding, or any other type of cladding may be placed over the lath.

Figure 3A:
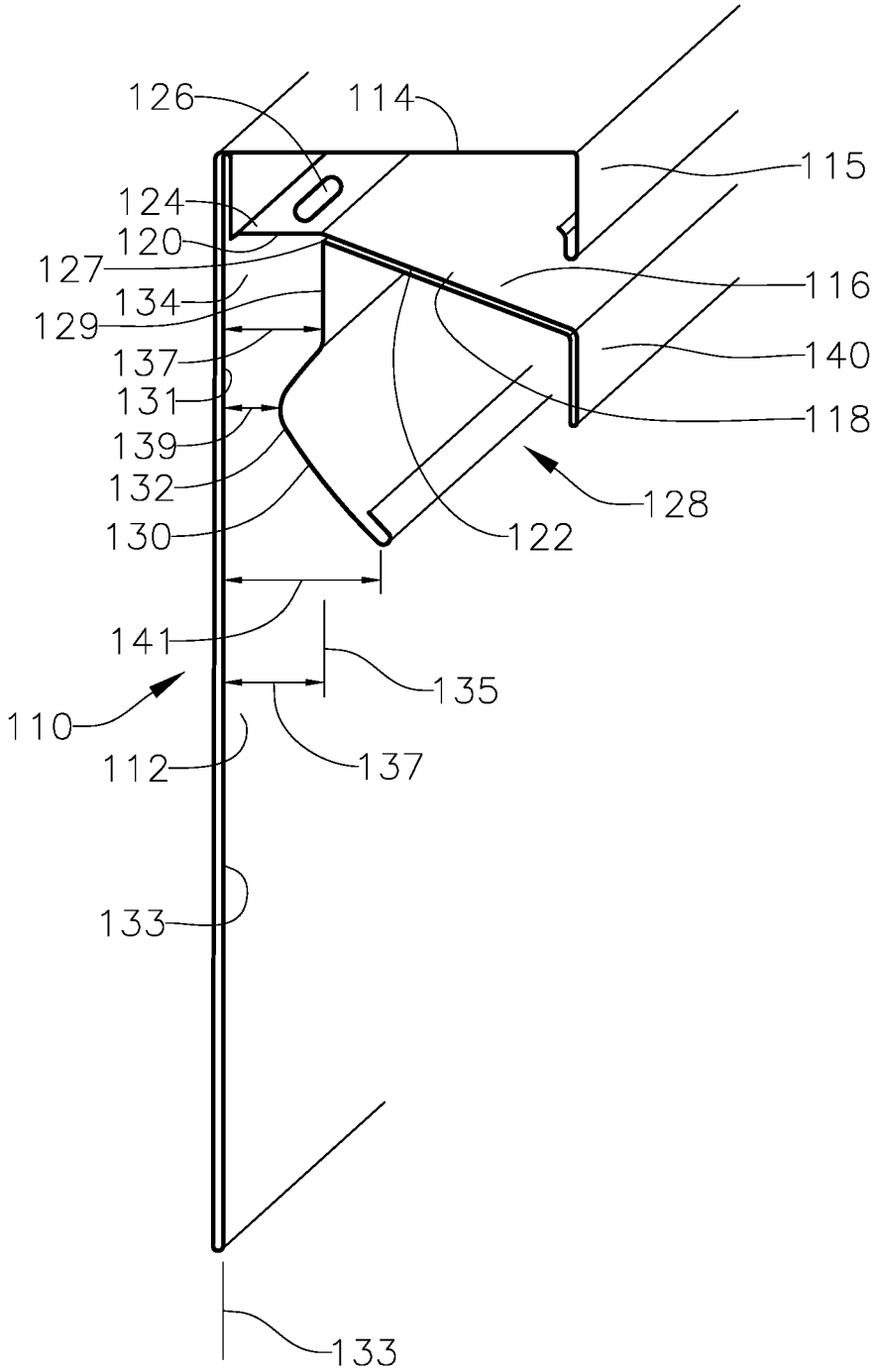
FIGS. 3A and 3B are partial perspective views of an example embodiment upper ventilation member.
Figure 4:
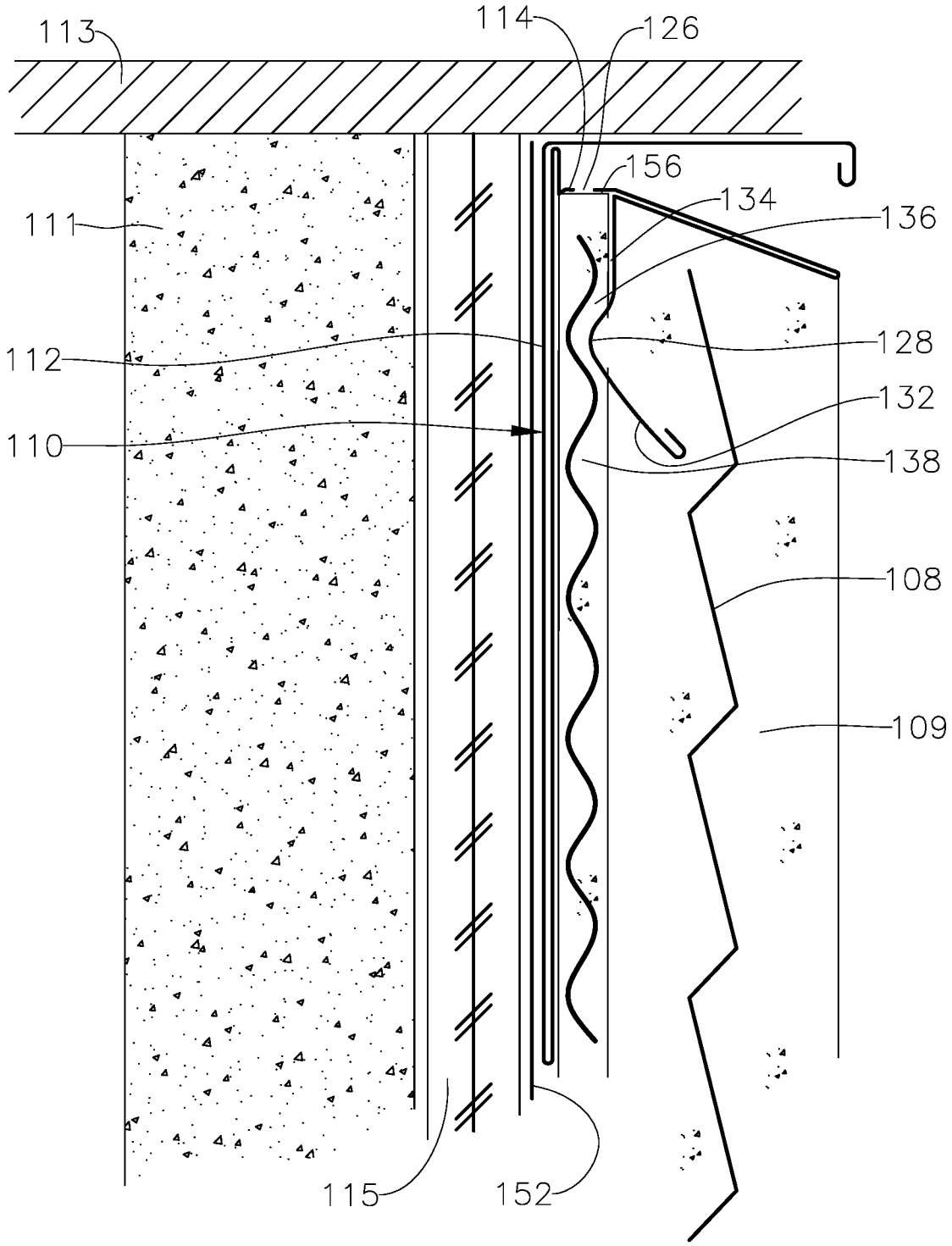
FIG. 4 is an end view of the example embodiment lower ventilation member shown in FIG. 3A mounted over a wall.

Another example embodiment ventilation member (referred to herein as a "upper ventilation member") 110 for use at or proximate an upper end of a wall 111, as for example proximate a roof or ceiling 113 as shown in the FIGS. 3A and 4 includes a base panel or nailing flange 112 for being mounted to the substrate 115 (e.g., a wall of a structure such as a building, or a sheathing or other material attached to such wall). In the example embodiment shown in FIG. 4, the substrate is a sheathing. An upper panel 114 extends transversely from the base panel 112. An optional vertically oriented leg 115 may extend downward from a distal end of the upper panel. A lower panel 116 forming a lower leg 118 extends transversely from the base panel and is inclined downward. In an example embodiment, a lip 140 may extend downward from the distal end of the lower leg 118.

In an example embodiment, the lower panel 116 has a first portion 120 adjacent the base panel and a second portion 122 extending from the first portion and in a direction away from the base panel. In an example embodiment, the first portion forms a shelf 124 that extends in a general horizontal orientation. The second portion 122 extends distally from the shelf and is inclined downwards. One or more vent openings 126 are formed through the shelf. A holding clip 128 extends downward from the leg at a location proximate, or at, the intersection 127 between the first and second portions 120, 122 of the lower panel. In one example embodiment, the holding clip 128 is a spring clip, while in another example embodiment it is a rigid clip. The holding clip has a base portion 129 and a head 130. The base portion 129 extends from the lower panel 116 and the head 130 extends distally from the base portion in a direction away from the lower panel. In the shown example embodiment, the head is a member having a curved (i.e., radiused) outer surface 132 defining an arc extending in a space 134. The space 134 is defined between a plane 133 of a surface 131 of the base panel facing the base portion of the holding clip and a generally parallel plane 135 of a surface 129 of the base portion of the holding clip facing the base panel, and is aligned with the one or more drain openings 126. The space 134 has a width 137 as measured perpendicularly between the generally parallel planes 133, 135 and is defined to receive an upper end portion 136 of a drainage mat 138 between the holding clip and the base panel. In a direction from base portion to the lower end of the head, the outer surface 132 of the head facing the base panel curves such that it extends into the space 134 such that a width 139 between the outer surface of the head and the plane of the base panel, parallel to the width 137 between generally parallel planes 133, 135, is smaller than the width 137. In an example embodiment, the distal end of the head extends in a direction away from the base panel such that a width 141 between outer surface of the head at its distal end and the base panel, parallel to the width 137, is greater than the width 137. The outer surface of the distal end portion of the head serves as a guide to receive and guide the upper end of drainage mat into the space 13 and the head serves to engage the drainage mat to hold it in the space. As the drainage mat is further slid into the space, it contacts the outer surface of the head of the holding clip, and in the example embodiment where the holding clip is a spring clip, causing it to move in a direction away from the base panel so as to allow the drainage mat to further slip higher into the space 134. The head which is spring biased to its original position exerts a force or pinches against the drainage mat for keeping it in position. In the example embodiment, where the holding clip is a rigid clip, as the drainage mat contacts the outer surface of the head, it is directed into the narrowed width 139 such that it is engaged by the outer surface of the holding clip head.

Figure 3B:
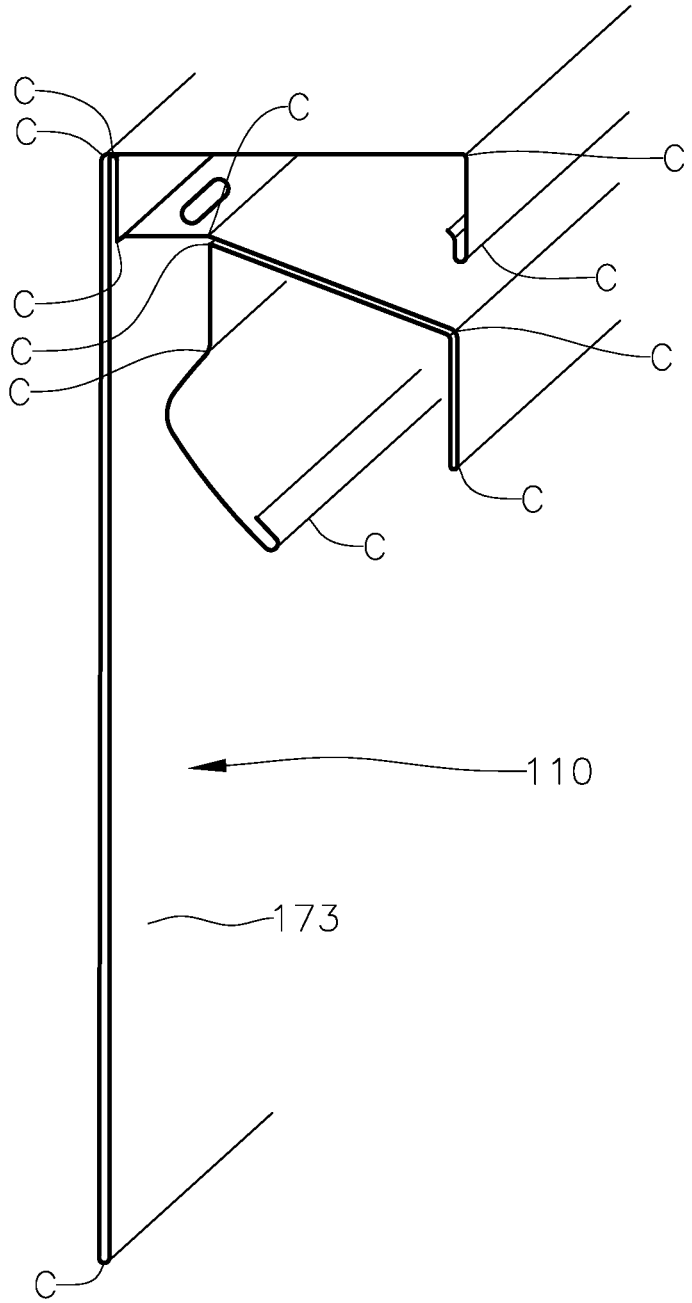
Figure 3C:
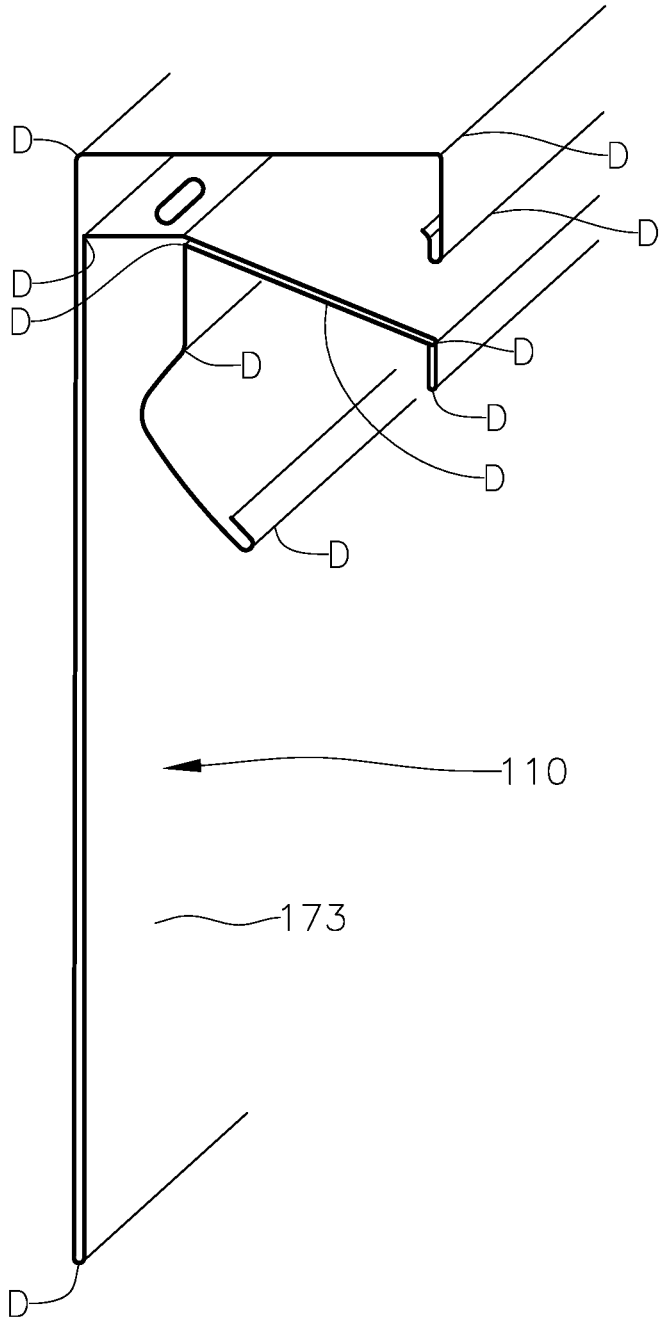
FIG. 3C is a partial perspective view of another example embodiment lower ventilation member.

In an example embodiment, the upper ventilation member 110 may be extruded from an extrudable material such as plastic or metal to be a unitary structure. In another example embodiment, one or more of the base panel, upper panel, lower pane, holding clip and any lips may be separate members that are connected or attached to each other. In further example embodiment the entire upper ventilation member is formed from a single or a unitary piece of material which is folded onto to itself. In example embodiments, a single panel 173 is used to form the upper ventilation member by bending the panel 173 at points C, or points D as shown in FIGS. 3B and 3C, respectively.

In an example embodiment, the upper ventilation member 110 is mounted at, or proximate an upper end of a wall 111 proximate a ceiling or roof 113, as for example shown in FIG. 4. In an example embodiment as shown in FIG. 4, a substrate 115 such as sheathing is placed over the wall. In another example embodiment, the wall itself is the substrate. A water resistive barrier layer 152 is placed over the substrate over the wall. The base panel 112 of the upper ventilation member is mounted over the water resistive barrier. An upper end portion 136 of a drainage mat 138 is then slid into position into the space 134 between the holding clip 128 and base panel such that the upper end 156 of the drainage mat contacts or is proximate the upper panel 114 and in line with the vent openings 126. The head 130 of the holding clip provides for an extended surface that is contacted by the upper end portion 136 of the drainage mat as it is slid into position. As the drainage mat is further pushed upward, it slides along the surface 132 of the holding clip head causing the holding clip in the example embodiment where it is a spring clip to move in a direction away from the base panel allowing the drainage mat to move into the space. The holding clip then due to its spring bias, returns to, or proximate, its original position, contacting or pinching upon the drainage mat for holding it into position. In the example embodiment, where the holding clip is a rigid clip the drainage mat slides along the outer surface 106 of the holding clip and as it gets pushed further up and into the space 134, and through the narrowed width 139, the head of the holding clip exerts a pressure against the drainage mat holding it in place. With these example embodiments, the width 139 is narrower than the width of the drainage mat. A lath 108 may then be placed over the drainage mat and cladding 109, as for example stucco, siding, or any other type of cladding may be placed over the lath. The end of the upper panel and the lip 140 if provided, provides a guide for the thickness of the applied cladding such as stucco.

Figure 5A:
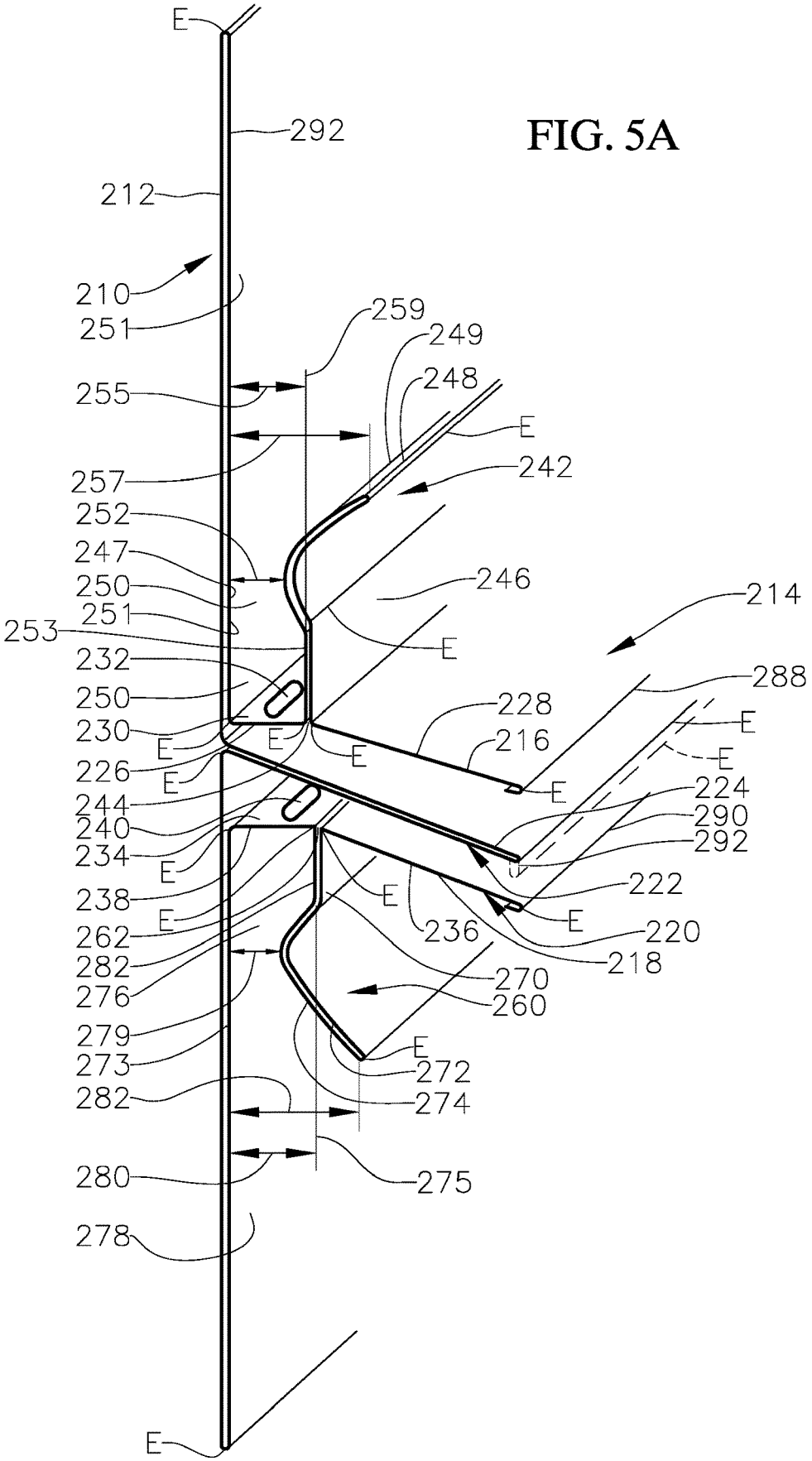
FIGS. 5A and 5D are a partial perspective views of an example embodiment mid-wall ventilation member.
Figure 6:
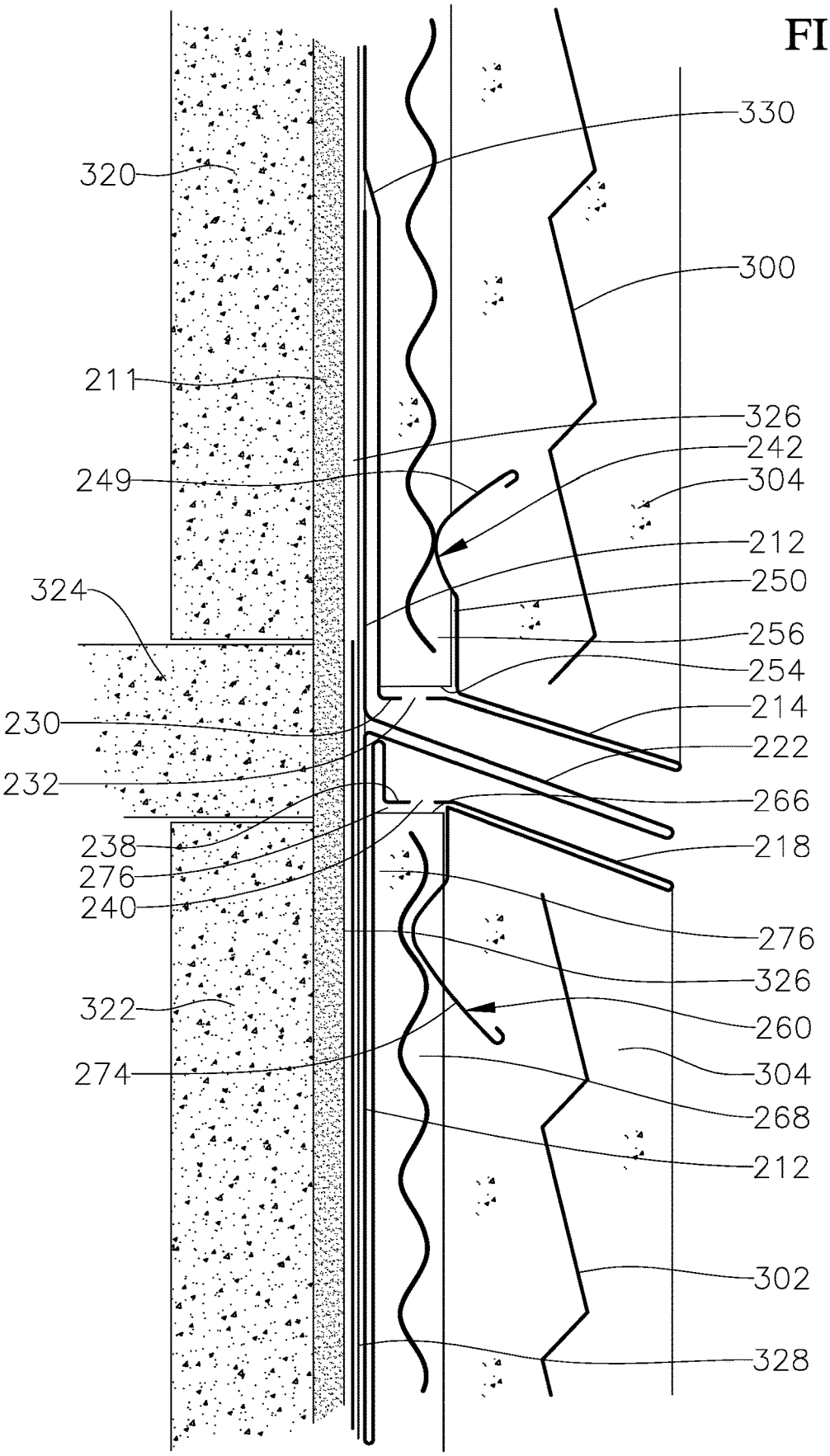
FIG. 6 is an end view of the example embodiment mid-wall ventilation member shown in FIG. 5A mounted over upper and lower walls.

A further example embodiment ventilation member 210 (referred to herein as a "mid-wall ventilation member") for use at or proximate a lower end of an upper wall and proximate an upper end of a lower wall, as for example between floors, as shown in the FIGS. 5A and 6, includes a base panel or nailing flange 212 for being mounted on a substrate 211 (e.g., a of wall of a structure such as a building, or another substrate such sheathing that may be mounted over such wall). A first or upper panel 214 extends transversely from the base panel forming a first leg 216. A second or lower panel 218 extends transversely from the base panel below the first panel proximate forming a second leg 220. A third panel 222 extends from the base panel between the first and second panels forming a third leg 224. In an example embodiment, the third panel is inclined downward in a direction away from the base panel. In one example embodiment, the first panel has a first portion 226 adjacent to the base panel and a second portion 228 extending distally from the first portion in a direction away from the base panel and inclined downward. The first portion defines a first shelf 230 and in the shown example embodiment, a generally horizontal shelf. One or more drain openings 232 are formed through the first shelf.

In the shown example embodiment, the second panel 218 has a first portion 234 adjacent to the base panel and a second portion 236 extending distally from the first portion of the second panel in a direction away from the base panel and inclined downward. The first portion of the second panel defines a second shelf 238 and in the shown example embodiment, a generally horizontal second shelf. One or more vent openings 240 are formed through the second shelf.

A first holding clip 242 extends upward from the first (upper) panel at a location proximate, or at the intersection 244 between the first and second portions 226, 228 of the first panel. In one example embodiment, the first holding clip is a spring clip and in another example embodiment it is a rigid clip. The first holding clip has a first base portion 246 and a first head 248. The first base portion extends from the upper panel and the first head extends from the distal end of the first base portion. In the shown example embodiment, the first head has a curved (i.e. radiused) outer surface 249 defining an arc extending in a first space 250, defined between a plane 247 along a surface 251 the base panel facing the first base portion, and a generally parallel plane 259 along a surface 253 of the first base portion facing the base panel, and aligned with the one or more drain openings 232. The space 250 has a width 255. In a direction from first base portion to the upper distal end of the first head, the first head outer surface curves such that its outer surface 249 extends into the first space 250 between the generally parallel planes 247, 259, such that a width 252 between the base panel surface 251 (i.e., plane 247) and the outer surface 249 of the head is less than the parallel width 255 of the first space and then curves in a direction away thereby increasing the width of the spacing between the base panel and the outer surface of the first head. In an example embodiment, the distal end of the first head extends in a direction away from the base panel such that a width 257 of the spacing between outer surface of the first head at its distal end and the base panel surface 251 is greater than a parallel width 255 of the first space. The outer surface of the distal end portion of the first head serves as a guide to receive and guide a lower end 254 of a first drainage mat 256 into the first space 250 between the first base portion and the base panel. As the first drainage mat is further pushed into the first space, it contacts the outer surface of the first head, and in the embodiment where the first holding clip is a spring clip, causing it to move in a direction away from the base panel so as to allow the first drainage mat to further slip lower into the first space. In the example embodiment where the first holding clip is a rigid clip, the outer surface of the first head guides the first drainage mat into the first space 250 and through the narrowed width 252 and the outer surface of the head contacts the first drainage mat for holding it in position. With these embodiments, the width of the drainage mat is greater that the narrowed width 252. The first head which is biased to its original position will return towards its original position and exert a force against the first drainage mat for keeping it in position.

A second holding clip 260 extends downward from the second (lower) panel at a location proximate or at the intersection 262 between the first and second portions 234, 236 of the lower panel. In one example embodiment, the holding clip is a spring clip and in another example embodiment, the holding clip is a rigid clip. The second holding clip has a second base portion 270 and a second head 272. The second base portion extends from the lower panel and the second head extends from the distal end of the second base portion. In the shown example embodiment, the second head has a curved (i.e. radiused) outer surface 274 defining an arc extending in a second space 276, defined between a plane 273 along a surface 278 the base panel facing the second base portion and a generally parallel plane 275 of a surface 282 of the second base portion facing the base panel, and aligned with the one or more vent openings 240. The second space 276 has width 280. In a direction from second base portion to the lower distal end of the second head, the second head outer surface curves such that its outer surface 274 extends into the second space 276 between the generally parallel planes 273, 275, such that a width 279 between the base panel surface 278 and the outer surface 274 of the second head is less than a parallel width 280 of the second space 276 and then curves in a direction away thereby increasing the width of the spacing between the base panel and the outer surface of the first head. In an example embodiment, the distal end of the second head extends in a direction away from the base panel such that a width 282 of spacing between outer surface of the second head at its distal end and the base panel surface 278 is greater than a parallel width 280 of the second space. The outer surface of the distal end portion of the first head serves as a guide to receive and guide an upper end 266 of a second drainage mat 268 into the second space 276 between the second base portion and the b base panel. As the second drainage mat is further pushed into the second space, it contacts the outer surface of the second head, and in the embodiment where the second holding clip is a spring clip, causing it to move in a direction away from the base panel so as to allow the second drainage mat to further slip into the second space. The second head which is spring biased to its original position then returns towards its original position exerting a force against the second drainage mat for keeping it in position. In the example embodiment, where the second holding clip is a rigid clip, as the second drainage mat contacts the outer surface of the second head it is guided into the second space 276 through the narrowed width 279 of the second space 276, such that the second head pinches or exerts a pressure against the second drainage mat holding it in place.

In an example embodiment, the distal ends of any panel such as the distal free ends 288, 290 of the upper and lower panels, respectively, may be rounded or blunt. In another example embodiment, a generally vertically and downwardly extending lip, such as lip 292 may extend from the distal end of any of the first, second and third panels.

In an example embodiment, the mid-wall ventilation member may be a extruded from an extrudable material such as plastic or metal to be a unitary structure. In another example embodiment, one or more of the base panel, first panel, second panel, third panel, first holding clip and the second holding clip, and any lips may be separate members that are connected or attached to each other. In further example embodiment the entire mid-wall ventilation member is formed from a single or a unitary piece of material which is folded onto to itself. In example embodiments, a single panel 292 is used to form the upper ventilation member at locations E as shown in FIG. 5A.

Figure 5B:
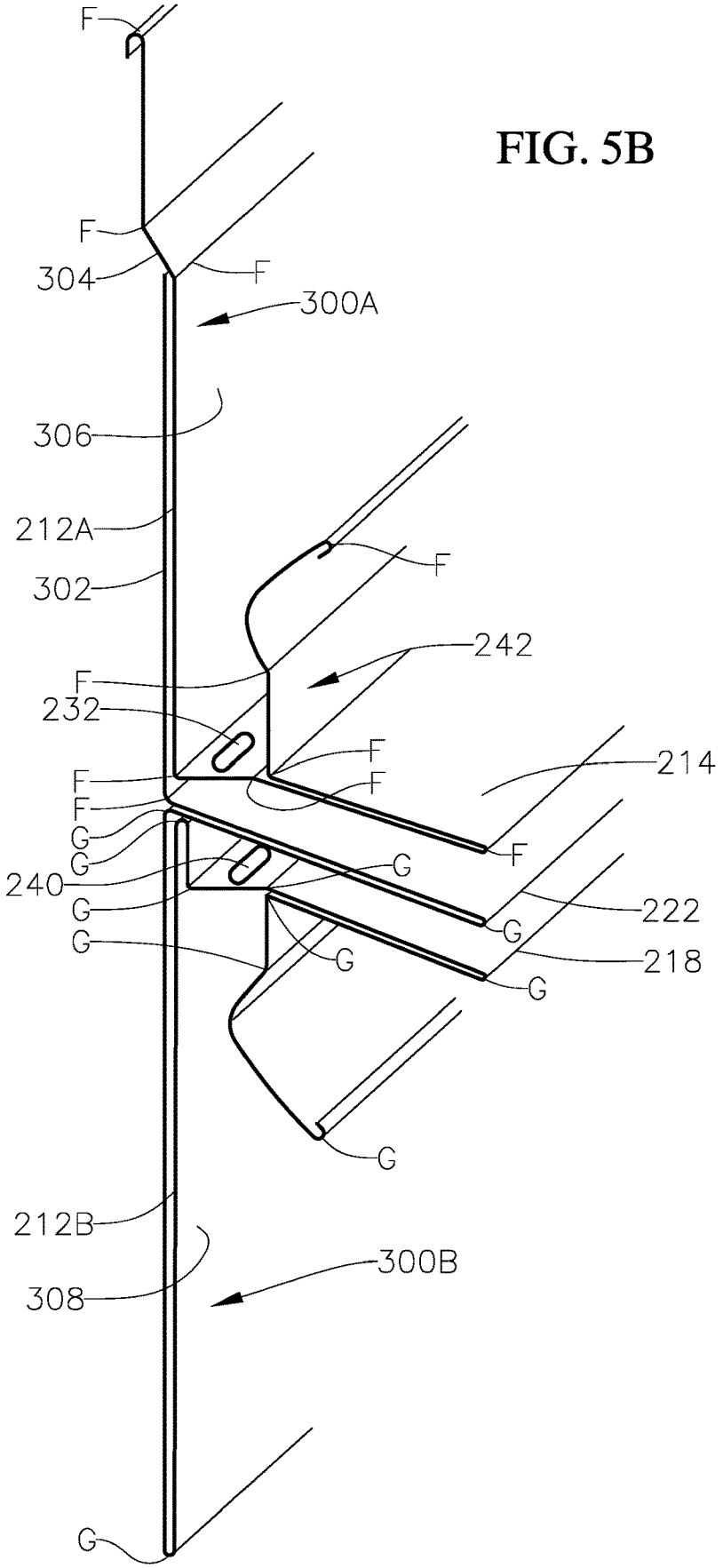
FIG. 5B is a partial perspective view of another example embodiment mid-wall ventilation member.
Figure 5C:
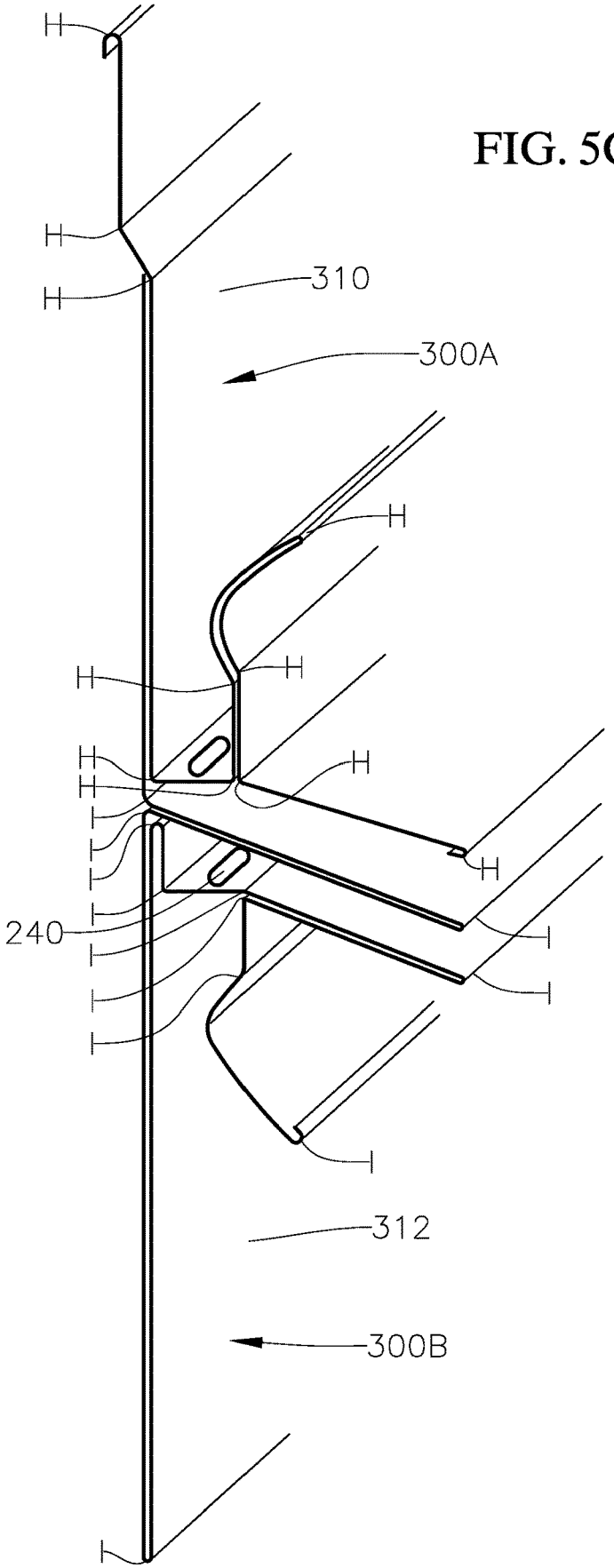
FIG. 5C is a partial perspective view of yet another example embodiment mid-wall ventilation member.

In another example embodiment, the mid-wall vent may be formed in two members, as shown for example in FIG. 5B. A first member 300A including a first base panel 212A from which extends the first panel 214 and the first holding clip 242 and a second member 300B including a second base panel 212B from which extend the second panel 218 and the third panel 222. The second base panel 212B includes a portion 302 extending above the third panel 222 that is slid behind the first base panel 212A. In this regard the distance of the first panel and the third panel may be varied to a desired distance by varying the position of the first base panel relative to the second base panel. To accommodate the portion 302 of the second base panel, the first base panel 212A may include an offset 304. In the shown example embodiment, the first and second members are each formed from separate single or unitary panels 306, 308 by being folded at locations F and G, respectively. In another example embodiment, as shown in FIG. 5C, the first and second members 300A, 300B are each formed from separate single or unitary panels 310, 312 by being folded at locations H and I, respectively. In other example embodiments, each of the first and second members 300A, 300B may be unitary structures formed by extrusion.

Figure 5D:
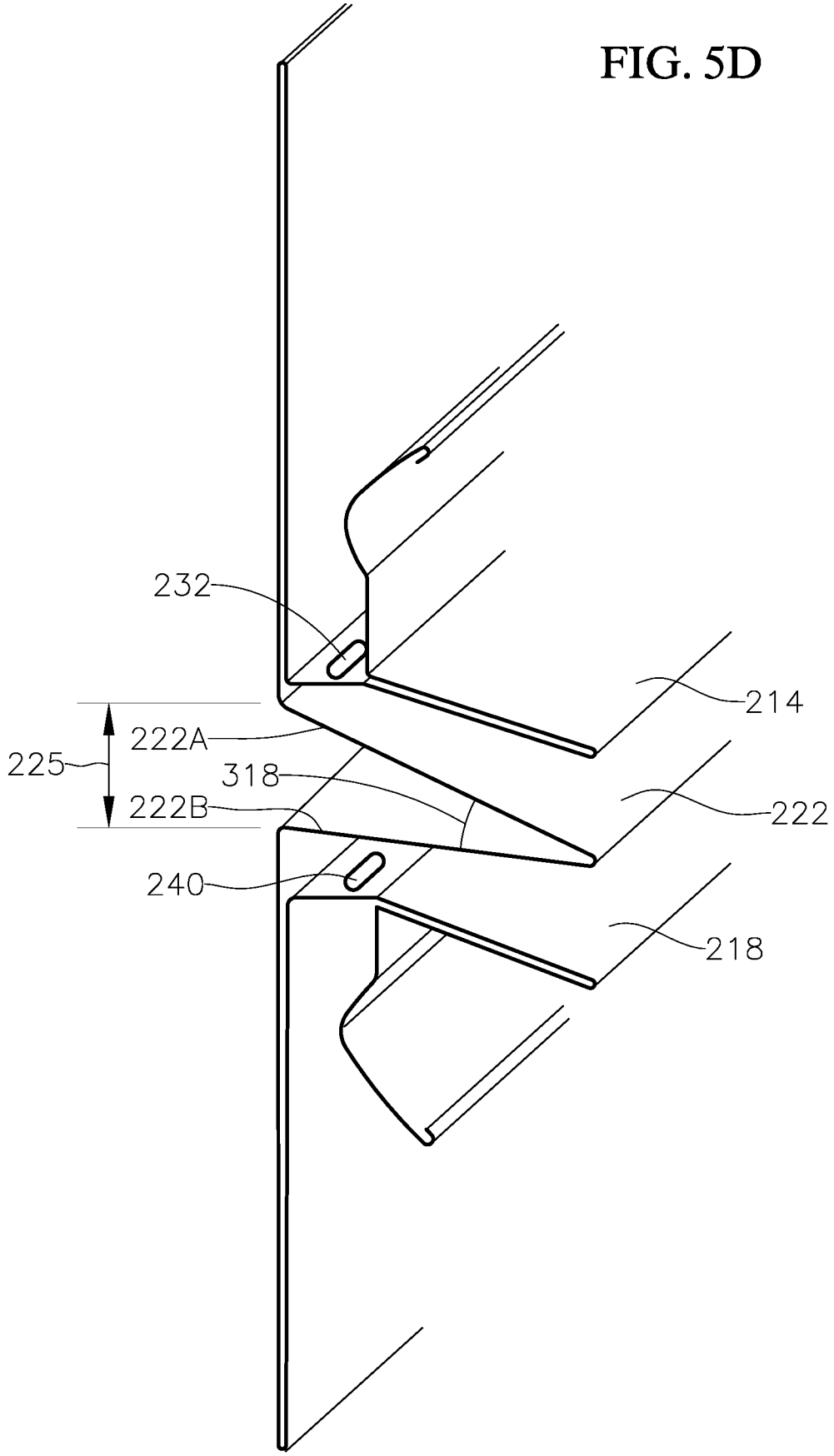

In any of the example embodiments shown formed by folding a sheet of material, a vertical distance 225 between the first and third panels 214, 218 at a location along the base panel may also be varied to a desired distance by varying an angle 318 of the fold forming the third panel 222 such that the portion of the material forming an upper surface 222A of the third panel is at an angle 318 relative to another portion of the material forming a lower surface 222B of the third panel as for example shown in FIG. 5D. As such, the larger the angle 318 the larger the spacing between the first and second base panels.

In an example embodiment, the mid-wall ventilation member is mounted over wall and often over an upper wall 320, a lower wall 322 and a floor 324 separating the upper and lower walls as shown in FIG. 6. In an example embodiment, a substrate such as sheathing 211 may be mounted over the walls and floors. A water resistive barrier 326 is mounted over the substrate. The water resistive barrier may extend over the lower wall and to a level up to, or including the floor. A first layer of flashing 328 is mounted over the water resistive layer and extends over the upper wall. In embodiments where the water resistive layer only extends to a level, part of the first flashing above that level is mounted directly to the substrate. The mid-wall ventilation member base panel 212 is mounted over the water resistive barrier and the first layer of flashing such the water resistive barrier and first layer of flashing are sandwiched between the base panel and the walls or sheathing. A second layer of flashing 330 is placed over the base panel portion extending above the upper panel 214 and extending from above the upper end of the base panel 222 and over the first layer of flashing 328 to, or proximate to, the at least one drain opening 232.

The first drainage mat 256 is slid downward into the first space 250 past the first holding clip 242 such that its lower end 254 abuts or is proximate the first shelf 230 in alignment with the at least one drain opening 232. As the first drainage mat is slid downward, the lower end 254 of the first drainage mat contacts the outer surface 249 of the first holding clip first head and due to the first head shape causes the first holding clip, in the embodiment where the first holding clip is a spring clip, to flex away from the base panel while at the same time it guides the first drainage mater into the first space 250. The first holding clip then flexes back toward its original position due to its spring bias providing a force against the first drainage mat for retaining the first drainage mat in the first space. In the embodiment where the first holding clip is a first rigid clip, the outer surface of the first head guides the first drainage mat into the first space 250 and through the narrowed width 252 and the outer surface of the head contacts the first drainage mat for holding it in position. The second drainage mat 268 is slid upward into the second space 276 past the second holding clip 260 such that its upper end 266 is at, or proximate, the second shelf 238 in alignment with the at least one vent opening 240. As the second drainage mat is slid upward, the upper end 266 of the second drainage mat contacts the outer surface 274 of the second holding clip second head and due to the second head shape causes the second holding clip, in the embodiment where the second holding clip is a second spring clip, to flex away from the base panel while at the same time it guides the second drainage mater into the second space 276. The second holding clip then flexes back to its original position providing a force against the second drainage mat for retaining the second drainage mat in the second space. In the example embodiment, where the second holding clip is a second rigid clip, as the second drainage mat contacts the outer surface of the second head it is guided into the second space 276 through the narrowed width 279 of the second space 276, such that the second head pinches or exerts a pressure against the second drainage mat holding it in place. Laths 300, 302 may then be placed over the upper and lower drainage mats and cladding 304, as for example stucco, siding, or any other type of cladding may be placed over the lath. The end of the upper panel, and the lip 140 if provided, provides a guide for the thickness of the applied cladding such as stucco.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. For example, in shown exemplary embodiments each of the ventilation member panels extend along a predetermined width of a substrate onto which they are mounted. In some example embodiments, the holding clips do not span the same width as any of the other panels. In addition, multiple shorter, minimal width spaced apart holding clips may be provided extending from their respective panels at locations along the width of such panels. In addition, the term "spring clip" as used herein does not necessarily mean that a spring is incorporated in the holding clip. Rather in example embodiments, it means that the clip after being moved from an initial position has the ability to spring back toward such initial position due a natural spring bias inherent in the material forming the holding clip and/or due to the thickness of the holding clip. Moreover, although relative terms such as "outer," "inner," "upper," "lower," "below," "above," and similar terms have been used herein to describe a spatial relationship of one element to another, it is understood that these terms are intended to encompass different orientations of the various elements and components of the invention in addition to the orientation depicted in the figures. Additionally, as used herein, the term "generally," "about," and similar terms are used as terms of approximation and not as terms of degree, and are intended to account for the inherent deviations in measured or calculated values that would be recognized by those of ordinary skill in the art. Furthermore, as used herein, when a component is referred to as being "on" or "over" another component, it can be directly on or over the other component, or components may also be present therebetween. Moreover, when a component is referred to as being "coupled" to another component, it can be directly attached to the other component or intervening components may be present therebetween. Furthermore "panel" as used herein refers to a single wall or a multi-wall panel such as a double wall panel that is formed by two adjacent back-to-back walls that can be formed for example by bending a layer of material onto to itself.

The invention claimed is:

1. A ventilation member comprising:

a base panel for mounting on a substrate;

a first panel extending transversely from the base panel;

a second panel extending transversely from the base panel and spaced apart from the first panel;

at least one opening formed through the second panel proximate the base panel; and a holding clip extending transversely from the second panel in a direction away from the first panel, wherein said holding clip comprises a curved outer surface defining an arc, wherein a space is defined between the holding clip and the base panel, wherein said space comprises a first width and second width narrower than the first width.

2. The ventilation member of claim 1, wherein the holding clip comprises a base portion extending from the first panel and head having said curved outer surface defining said arc extending distally from the base portion.

3. The ventilation member of claim 2, wherein the space has a width as measured between a surface of the base panel facing the holding clip and a surface of the holding clip base portion facing the base panel, wherein said width decreases and then increases in a direction from the proximal end of the head adjacent the base portion to the distal end of the head.

4. The ventilation member of claim 3, wherein the width at the distal end of the head is greater than the width at the proximal end of the head.

5. The ventilation member of claim 1, wherein the second panel comprises a first portion forming a shelf adjacent the base panel and a second portion extending distally from the first portion in a direction away from the base panel, wherein said at least one opening is formed through said shelf.

6. The ventilation member as recited in claim 5, wherein the first panel forms a lower leg extending from, or proximate a lower end of, the base panel, and inclining downward from the base panel and wherein the second panel forms an upper leg above the lower leg, wherein said second portion of the second member inclines downward from the shelf.

7. The ventilation member as recited in claim 5, wherein the first panel forms an upper leg extending from, or proximate, an upper end of the base panel and the second panel forms a lower leg, wherein the second portion of the second panel inclines downward from the shelf.

8. The ventilation member as recited in claim 1, further comprising at least one of a first leg portion extending downward from the first panel and a second leg portion extending downward from the second panel.

9. The ventilation member as recited in claim 1, wherein said ventilation member is formed by extrusion.

10. The ventilation member as recited in claim 1, wherein said ventilation member base panel, first panel, second panel, and holding clip are integrally formed by bending a single sheet of material to sequentially define each of said base panel, first panel, second panel and holding clip.

11. The ventilation member as recited in claim 1, wherein the holding clip is moveable for allowing for insertion of a drainage mat into the space and is biased for providing pressure against the drainage mat once inserted into the space.

12. The ventilation member as recited in claim 1, wherein the holding clip is a rigid member, and wherein the holding clip comprises a surface portion at the second width for engaging a drainage mat once inserted into the space.

13. The ventilation member as recited in claim 1, wherein the holding clip is a spring clip, wherein said holding clip when moved in a direction away from the base panel it is biased to spring back toward the base panel.

14. A ventilation member comprising:

a base panel for mounting on a substrate;

a first panel extending transversely from the base panel;

a second panel extending transversely from the base panel and spaced apart from the first panel;

at least one opening formed through the second panel proximate the base panel; and a holding clip extending transversely from the second panel in a direction away from the first panel, wherein a space is defined between the holding clip and the base panel, wherein said space comprises a first width and second width narrower than the first width, wherein the holding clip is a spring clip, wherein said holding clip when moved in a direction away from the base panel it is biased to spring back toward the base panel.

15. The ventilation member of claim 14, wherein the holding clip comprises a base portion extending from the first panel and head having a curved outer surface extending distally from the base portion.

16. The ventilation member of claim 15, wherein the space has a width as measured between a surface of the base panel facing the holding clip and a surface of the holding clip base portion facing the base panel, wherein said width decreases and then increases in a direction from the proximal end of the head adjacent the base portion to the distal end of the head.

17. The ventilation member of claim 16 wherein the width at the distal end of the head is greater than the width at the proximal end of the head.

18. The ventilation member as recited in claim 14, wherein said ventilation member is formed by extrusion.

19. The ventilation member as recited in claim 14, wherein said ventilation member base panel, first panel, second panel, and holding clip are integrally formed by bending a single sheet of material to sequentially define each of said base panel, first panel, second panel and holding clip.

20. A ventilation member comprising:

a base panel for mounting on a substrate;

a first panel extending transversely from the base panel;

a second panel extending transversely from the base panel and spaced apart from the first panel;

at least one opening formed through the second panel proximate the base panel; and a holding clip extending transversely from the second panel in a direction away from the first panel, wherein a space is defined between the holding clip and the base panel, wherein said space comprises a first width and second width narrower than the first width, wherein the holding clip comprises a base portion extending from the first panel and head having a curved outer surface extending distally from the base portion, wherein the space has a width as measured between a surface of the base panel facing the holding clip and a surface of the holding clip base portion facing the base panel, wherein said width decreases and then increases in a direction from the proximal end of the head adjacent the base portion to the distal end of the head, and wherein the width at the distal end of the head is greater than the width at the proximal end of the head.

* * * * *